United States Patent [19]

Kasai

[11] Patent Number: 4,742,603

[45] Date of Patent: May 10, 1988

[54] SEPARABLE BOTTOM-END-STOP ASSEMBLY FOR SEPARABLE SLIDE FASTENER

[75] Inventor: Kazumi Kasai, Namerikawa, Japan

[73] Assignee: Yoshida Kogyo K.K., Tokyo, Japan

[21] Appl. No.: 878,012

[22] Filed: Jun. 24, 1986

[30] Foreign Application Priority Data

Jun. 26, 1985 [JP] Japan ..... 60-97283[U]

[51] Int. Cl.[4] ..... A44B 19/36

[52] U.S. Cl. ..... 24/433; 24/434

[58] Field of Search ..... 24/433, 434

[56] References Cited

U.S. PATENT DOCUMENTS

| | | | |
|---|---|---|---|
| 3,110,946 | 11/1963 | Hara | 24/433 |
| 3,616,939 | 11/1971 | Potin | 24/433 X |
| 4,078,279 | 3/1978 | Heimberger | 24/434 |
| 4,104,767 | 8/1978 | Warren | 24/433 |
| 4,221,026 | 9/1980 | Kanzaka | 24/433 |
| 4,270,248 | 6/1981 | Akashi | 24/433 |
| 4,447,936 | 5/1984 | Kusayama | 24/433 |

*Primary Examiner*—Peter A. Aschenbrenner

*Attorney, Agent, or Firm*—Hill, Van Santen, Steadman & Simpson

[57] ABSTRACT

A bottom-end-stop assembly for a slide fastener comprises a pair of intercoupling male and female members of thermoplastic synthetic resin adapted to be molded on adjacent bottom ends of opposed fastener stringers. The male member has an inner longitudinal projection and a pivot pin. The female member has an inner longitudinal groove receptive of the projection, and an inwardly opening support hole receptive of the pivot pin for pivotal movement of the male member. The male member has at least one aperture in the projection so that the stringer tape is clamped between a pair of mold members so as not to become wavy during the molding. The male member also has on opposite surfaces a pair of reinforcing ridges remote from the inner longitudinal side of the male member.

4 Claims, 3 Drawing Sheets

SEPARABLE BOTTOM-END-STOP ASSEMBLY FOR SEPARABLE SLIDE FASTENER

BACKGROUND OF THE INVENTION

1. Field of the Invention

The present invention relates to a separable bottom-end-stop assembly of thermoplastic synthetic resin for a separable slide fastener.

2. Description of the Prior Art

U.S. Pat. No. 4,221,026 issued Sept. 9, 1980 discloses a separable bottom-end-stop assembly, for a slide fastener, of a so-called lateral insertion type. As reillustrated here in FIG. 6 of the accompanying drawings, this type of separable bottom-end-stop assembly comprises a pair of intercoupling male and female members A, B of thermoplastic synthetic resin mounted on adjacent bottom ends of opposed fastener stringers by molding. The male member A extends along an inner longitudinal edge of one stringer tape and has at its inner side a longitudinal projection F and at its lower end a pivot pin C. The female member B extends along an inner longitudinal edge of the other stringer tape and has at its inner side a longitudinal groove G receptive of the longitudinal projection F and, at a position near its lower end E, a support hole D opening obliquely inwardly for receiving the pivot pin C. For coupling the male and female members A, B together, the pivot pin C of the male member A is inserted in the support hole D of the female member B, and then the male member A is pivctally moved about the pivot pin C to cause the projection F to be laterally received in the groove G.

In production, a pair of opposed stringer tapes are clamped between a pair of upper and lower mold halves jointly defining a pair of mold cavities each having a contour corresponding to the shape of a respective one of the male and female members A, B. Then molten thermoplastic synthetic resin is injected into the mold cavities to form the male and female members A, B directly on the respective stringer tapes. At that time, the stringer tapes tend to become wavy in the mold cavities because the latter are hollow and hence there are no parts pressing the stringer tapes. As a result, the male and female members are molded on the wavy stringer tapes in such a manner that the latter are locally and irregularly exposed to the surface of the molded members, especially to the surface of the male member, which has only a limited thickness, thus impairing not only the appearance but the bending strength of the molded article.

If the male member were to have an increased thickness, the gap between upper and lower guide flanges of a slider must be increased; that is, the height of the guide flanges must be short. With such short guide flanges, smooth and correct coupling of opposed fastener element rows is difficult to achieve.

SUMMARY OF THE INVENTION

It is therefore an object of the present invention to provide a bottom-end-stop assembly, for a slide fastener, which is neat in appearance and has an adequate bending strength, guaranteeing smooth coupling of opposed fastener element rows.

According to the present invention, a bottom-end-stop assembly for a slide fastener comprises a pair of intercoupling male and female members of thermoplastic synthetic resin adapted to be molded on adjacent bottom ends of opposed fastener stringers. The male member has an inner longitudinal projection and a pivot pin. The female member has an inner longitudinal groove receptive of the projection, and an inwardly opening support recess receptive of the pivot pin for pivotal movement of the male member. The male member has at least one aperture in the projection so that the stringer tape is clamped between a pair of mold members so as not to become wavy during the molding. The male member also has on opposite surfaces a pair of reinforcing ridges remote from the inner longitudinal side of the male member.

Many other objects, features and additional advantages of the present invention will become manifest to those versed in the art upon making reference to the detailed description and the accompanying drawings in which a preferred embodiment incorporating the principles of the present invention is shown by way of illustrative example.

DETAILED DESCRIPTION

Figure 1:
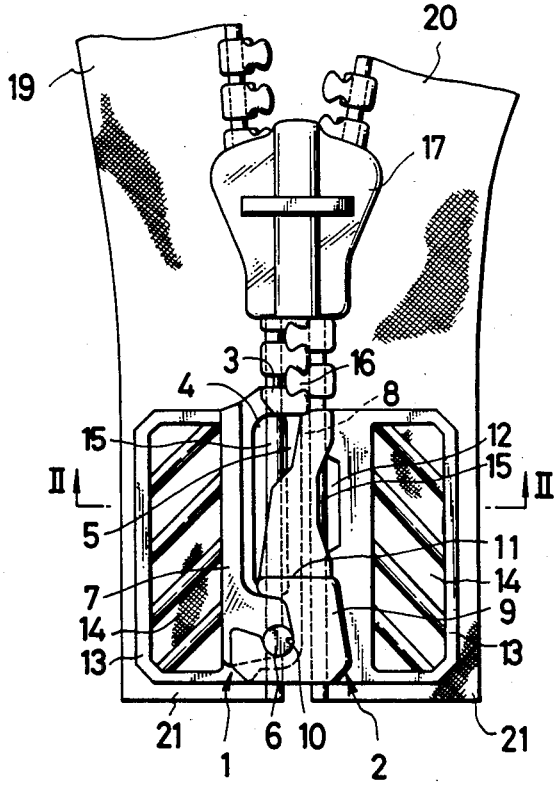
FIG. 1 is a fragmentary plan view of a separable slide fastener having a separable bottom-end-stop assembly embodying the present invention.

FIG. 1 shows a separable slide fastener comprising a pair of fastener stringers 19, 20 each including a stringer tape 21 carrying on and along its inner or first longitudinal margin a row of coupling elements 16 in the form of separate scoops made of thermoplastic synthetic resin. A separable bottom-end-stop assembly is mounted on adjacent bottom ends of the stringers 19, 20 at the respective bottom end portions of the confronting inner tape-margins. The bottom end portion is devoid of several coupling elements 16, the number of which is not pertinent here. A slider 17 is threaded on the opposed rows of coupling elements 16 for movement therealong to close and open the slide fastener. Each stringer tape 21 has a core thread 15 extending along its inner longitudinal edge. As shwon in FIGS. 1, 3 and 4, the separable bottom-end-stop assembly includes a pair of intercoupling male and female members 1, 2 of thermoplastic synthetic resin mounted on adjacent bottom end portions of the opposed inner longitudinal tape-margins by injection molding.

Figure 2:
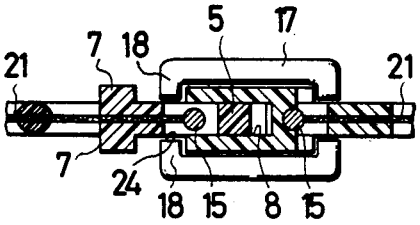
FIG. 2 is a transverse cross-sectional view taken along line II—II of FIG. 1.

The male member 1 has at its upper end a coupling-element receiving portion 3 engageable with the lowermost coupling element 16 on the companion stringer tape 21, at its lower end a pivot pin 6, and an inwardly (rightwardly in FIGS. 1 and 2) facing longitudinal projection 5 extending longitudinally of the stringer tape; between the coupling-element receiving portion 3 and the pivot pin 6.

The female member 2 has an inwardly (leftwardly in FIGS. 1 and 2) facing longitudinal groove 8 receptive of the projection 5 of the male member 1, and in its lower base portion 9 an obliquely inwardly opening support recess 10 receptive of the pivot pin 6 of the male member 1 so that the latter is pivotable about the pivot pin 6 and hence the support recess 10. Thus the projection 5 of the male member 1 can be inserted into the groove 8 of the female member 2 substantially laterally thereof as described below.

Each of the male and female members 1, 2 has a pair of parallel reinforcing wings 13, 13 disposed one on each side of the respective stringer tape 21, each reinforcing wing 13 extending integrally from the respective member 1, 2 toward and terminating short of the outer longitudinal tape edge and having a plurality of windows 14.

Most importantly, the male member 1 has a longitudinal aperture 4 in the projection 5 so as to expose a portion of the inner tape edge (including the core thread 15) to view, and also has a pair of longitudinal reinforcing ridges 7, 7 disposed one on each surface of the stringer tape 21 remotely from the inner edge of the projection 5. Although in the illustrated embodiment the male member 1 has only one elongated aperture 4, it may have two or more short apertures. The female member 2 has an aperture 12 so as to expose a portion of the inner tape edge (including the core thread 15) to view.

Figure 5:
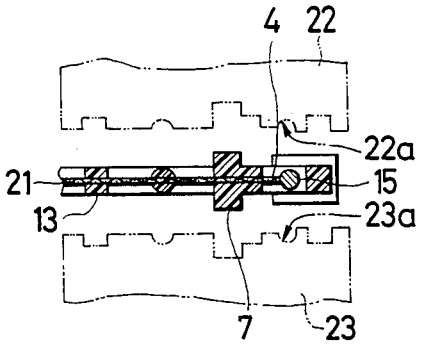
FIG. 5 is an enlarged transverse cross-sectional view taken along line V—V of FIG. 4, illustrating the manner in which the stringer tape is clamped between a pair of mold members.
Figure 6:
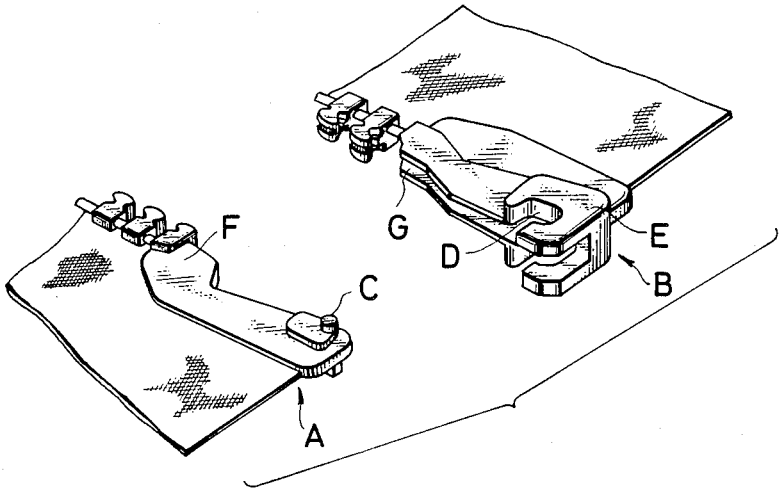
FIG. 6 PRIOR ART
FIG. 6 is a fragmentary perspective view similar to FIG. 4, showing a prior art bottom-end-stop assembly.

Having the apertures 4, 12, the bottom-end-stop assembly of the present invention is particularly advantageous in that the inner longitudinal edge of the stringer tape 21 can be clamped stably between opposed projecting portions 22*a*, 23*a* (FIG. 5) of a pair of mold members 22, 23 so as not to become wavy during the molding. The aperture 12 of the female member 2 is not absolutely necessary because the female member 2 has an adequate thickness along its entire length. But from an aesthetic view point, it is perferable to form the aperture 12 in the female member 2 at a position generally symmetrical with respect to the aperture 4 in the male member 1. The longitudinal reinforcing ridges 7, 7 serve to compensate for the loss in structural strength of the male member 1 due to the aperture 4.

Figure 3:
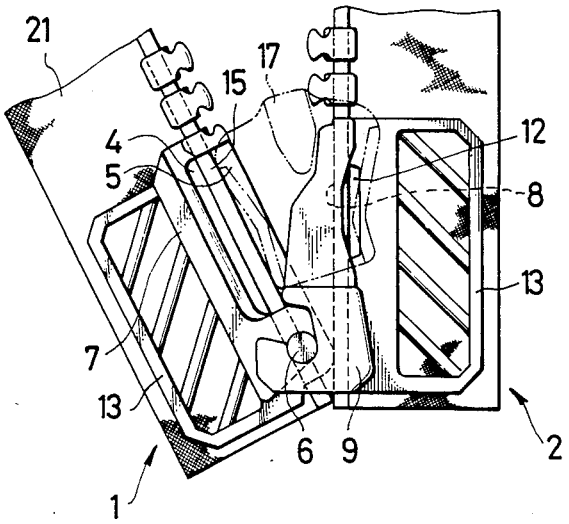
FIG. 3 is a fragmentary plan view of the separable slide fastener, showing the manner in which the bottom-end-stop assembly is separated.
Figure 4:
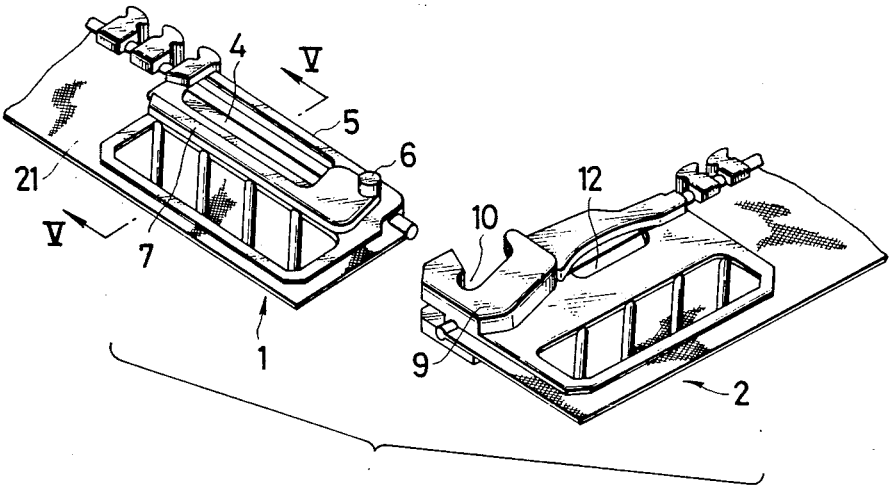
FIG. 4 is a fragmentary perspective view of the separable slide fastener, showing the bottom-end-stop assembly having been fully separated.

In operation, when the slider 17 is moved downwardly in FIG. 1 until the rear end of the slider 17 abuts against an upper surface 11 of the base portion 9 of the female member 2, the pair of rows of coupling elements 16, 16 is disengaged all the way, whereupon the male member 1 is pivotally moved counterclockwise about the pivot pin 6 received in the support recess 10, as shown in FIG. 3. Then the pivot pin 6 is removed from the support recess 10. Thus the male member 1 has been completely separated from the female member 2. On the contrary, to couple the male and female members 1, 2 together, with the slider 17 in fully lowered position, the pivot pin 6 of the male member 1 is inserted in the support recess 10 of the female member 2. Then the projection 5 of the male member 1 is inserted into the groove 8 of the female member 2, through the gap between opposed guide flanges 18, 18 (FIG. 2) of the slider 17, by pivotally moving the male member 1 clockwise in FIG. 3 about the pivot pin 6.

In the illustrated embodiment, the pin-and-recess connection is employed. Alternatively, the male member 1 may have a hook, and the female member 2 may in turn have a recess receptive of the hook.

According to the present invention, because of the aperture in the male member, it is possible to prevent the inner longitudinal edge of the stringer tape from becoming wavy during the molding of the male member, without increasing the thickness of the projection, thus making the assembly neat in appearance and free from local and irregular disposition of the tape edge portion with respect to the surface of the male member. Further, the reinforcing ridges serve not only to compensate for the loss in structural strength of the male member due to the aperture, but to improve the bending strength in the longitudinal direction. Moreover, since the reinforcing ridges extend alongside the path of the slider, it is possible to prevent a portion of a garment from being caught between the male member and the guide of the slider.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A separable bottom-end-stop assembly for a separable slide fastener including a pair of fastener stringers, each including a stringer tape carrying on a first longitudinal margin a row of coupling elements, the first tape-margin having a bottom end portion devoid of coupling elements, said assembly comprising:

(a) a male member of thermoplastic synthetic resin adapted to be molded on the bottom end portion of the first tape-margin of one stringer, and having a longitudinal projection and a pivot pin;

(b) a female member of thermoplastic synthetic resin adapted to be molded on the bottom end portion of the first tape-margin of the other stringer, and having a longitudinal groove receptive of said projection and a support hole receptive of said pivot pin; and (c) said male member having at least one first aperture in said projection so as to expose a portion of the first tape-margin of the one stringer to view, said male member having a pair of reinforcing ridges, disposed one on each surface of the stringer tape remotely from a longitudinal edge of said projection.

2. A separable bottom-end-stop assembly according to claim 1, said female member having at least one second aperture so as to expose a portion of the first tape-margin of the other stringer to view.

3. A separable bottom-end stop assembly according to claim 1, said first aperture extending along the first tape-margin of the one stringer, said reinforcing ridges extending parallel to the length of said first aperture.

4. A separable bottom-end-stop assembly according to claim 2, said second aperture extending along the first tape-margin of the other stringer.

* * * * *